US009074309B1

(12) United States Patent
Schwarzberger et al.

(10) Patent No.: US 9,074,309 B1
(45) Date of Patent: Jul. 7, 2015

(54) METHOD, APPARATUS AND COMPUTER-READABLE MEDIUM FOR SEQUIN ATTACHMENT

(71) Applicant: ABM International, Inc., The Woodlands, TX (US)

(72) Inventors: Neal A. Schwarzberger, The Woodlands, TX (US); William E. Schnaufer, Rochester, NY (US)

(73) Assignee: ABM International, Inc., The Woodlands, TX (US)

( * ) Notice: Subject to any disclaimer, the term of this patent is extended or adjusted under 35 U.S.C. 154(b) by 0 days.

(21) Appl. No.: 14/182,399

(22) Filed: Feb. 18, 2014

(51) Int. Cl.

| | |
|---|---|
| ***D05B 3/12*** | (2006.01) |
| ***D05B 19/08*** | (2006.01) |
| ***D05B 19/14*** | (2006.01) |
| *D05C 7/08* | (2006.01) |

(52) U.S. Cl.
CPC *D05C 7/08* (2013.01); *D05B 19/08* (2013.01); *D05B 19/14* (2013.01)

(58) Field of Classification Search
CPC ..... D05B 3/00; D05B 3/12; D05B 3/14; D05B 3/22; D05C 7/08
USPC ..... 112/475.01, 475, 18, 98, 99, 113, 104
IPC ..... D05B 3/12; D05C 7/08
See application file for complete search history.

(56) References Cited

U.S. PATENT DOCUMENTS

| | | | | |
|---|---|---|---|---|
| 5,054,407 | A | 10/1991 | Rowley | |
| 5,755,168 | A | 5/1998 | Günther et al. | |
| 6,123,038 | A | 9/2000 | Kames et al. | |
| 6,883,446 | B2 | 4/2005 | Koerner | |
| 6,971,325 | B1 * | 12/2005 | Inaba | 112/475.19 |
| 7,082,884 | B2 | 8/2006 | Tajima et al. | |
| 7,934,461 | B2 * | 5/2011 | Tajima | 112/475.01 |
| 2005/0016428 | A1 | 1/2005 | Koerner | |

(Continued)

FOREIGN PATENT DOCUMENTS

| | | | |
|---|---|---|---|
| EP | 1597421 | A | 11/2005 |
| EP | 1652984 | A1 | 5/2006 |
| WO | 2004072349 | A2 | 8/2004 |

OTHER PUBLICATIONS

ABM International website—Innova Longarm Quilting Machine (Apr. 8, 2013) http://www.abminternational.com/innova—long—arm—quilting—machine.php (13 pages).

*Primary Examiner* — Ismael Izaguirre
(74) *Attorney, Agent, or Firm* — Timothy W. Menasco, Esq.; Harter Secrest & Emery LLP

(57) ABSTRACT

Presented is a method, apparatus and computer-readable medium for affixing a sequin to a work piece. The method includes sensing, by a sensor, a position and movement of a sewing head having a reciprocating needle relative to a support frame. The method further includes in response to a user input, presenting, by a sequin feeder, a sequin to a needle drop location of the reciprocating needle at a time corresponding to a predetermined part of the reciprocating needle cycle. The method further includes in response to the sensed position of the reciprocating needle, adjusting a speed of the reciprocating needle based on a size of the sequin.

18 Claims, 4 Drawing Sheets

(56) References Cited

U.S. PATENT DOCUMENTS

| | | | | |
|---|---|---|---|---|
| 2005/0066866 | A1 | 3/2005 | Pederzini | |
| 2007/0119357 | A1* | 5/2007 | Tajima | 112/104 |
| 2007/0199490 | A1 | 8/2007 | Suzuki | |
| 2008/0087206 | A1* | 4/2008 | Murase | 112/106 |
| 2008/0264316 | A1* | 10/2008 | Tajima et al. | 112/113 |
| 2010/0313806 | A1 | 12/2010 | König et al. | |
| 2013/0298811 | A1* | 11/2013 | Prufer, Frank | 112/2 |
| 2014/0109815 | A1* | 4/2014 | Muto | 112/470.04 |

* cited by examiner

METHOD, APPARATUS AND COMPUTER-READABLE MEDIUM FOR SEQUIN ATTACHMENT

CROSS-REFERENCE TO RELATED APPLICATIONS

None.

STATEMENT REGARDING FEDERALLY SPONSORED RESEARCH OF DEVELOPMENT

Not applicable.

REFERENCE TO A "SEQUENCE LISTING"

Not applicable.

BACKGROUND OF THE INVENTION

1. Field of the Invention

The present invention relates to a method, apparatus and computer-readable medium for decorating a work piece with decorative elements. The present invention relates more specifically to the decoration of a work piece with sequins.

2. Description of Related Art

The process or quilting requires the use of a needle and thread to join two or more layers of material to make a quilt. Quilting is traditionally done with a top fabric layer or quilt top, a batting or insulating material and backing material. The quilter's hand or machine passes the needle and thread through all layers and then brings the needle back up. The process is repeated across the entire area where quilting is wanted. Quilting is done to create bed spreads, art quilt wall hangings, clothing, and a variety of textile products. One specific type of decoration for a quilt is a sequin.

Sequins are reflective disk-shaped beads used for decorative purposes. They are available in a wide variety of colors and geometric shapes. Sequin attachments have been developed for use in commercial embroidery machines. The embroidery machine functions by automatically placing sequins under the needle for stitching it down to a single piece of fabric or multiple layers of fabric in the case of a quilt.

An embroidery machine operates with the use of a fabric holding mechanism, which is able to move in an X and Y-axis directions for the purpose of creating patterns or pictures on the fabric. A computer controlling the X-axis and Y-axis motors of the embroidery machine typically generates the patterns or pictures. The computer also simultaneously controls the needle. The up and down motion of the needle as well as its movement along the X and Y-axis are locked together through the motor controls. The stitching, spacing and placement of each sequin on a given piece of fabric for the embroidery machine is preprogrammed into the computer prior to the start of any project. This system does not allow for impromptu addition of sequins to a given piece of work.

Sequin attachments have also been developed for the standard sewing machine. The sewing machine sequin attachments operate by the use of a foot pedal. The operator presses a foot pedal and the machine moves the needle at a predetermined speed to create a certain stitch length. If the operator desires a different stitch length then the operator can turn a mechanical knob, which adjusts the feed rate of the fabric to maintain the desired stitch length. The sequin attachment is locked to the needle drive mechanism of the sewing machine, which feeds a sequin every time the needle is in the up position. There is no computer control of the sequins attachment with the standard sewing machine. Additionally, each time the operator desires to change the stitch length, change the sequin spacing or even add sequins the operator must release the foot pedal and manually adjust the stitch length. This does not allow the operator to seamlessly move between sequin and non-sequin stitching.

SUMMARY OF THE INVENTION

In view of the foregoing, it is an object of the present invention to provide a method, apparatus and computer-readable medium for affixing a sequin to a work piece.

A first exemplary embodiment of the present invention provides a method for affixing a sequin to a work piece. The method comprises sensing, by a sensor, a position and movement of a sewing head having a reciprocating needle relative to a support frame and in response to a user input, presenting, by a sequin feeder, a sequin to a needle drop location of the reciprocating needle at a time corresponding to a predetermined part of the reciprocating needle cycle. This embodiment further comprises in response to the sensed position of the reciprocating needle, adjusting a speed of the reciprocating needle based on a size of the sequin.

A second exemplary embodiment of the present invention provides an apparatus for affixing a sequin to a work piece. The apparatus comprises a support frame, a sewing head including a reciprocating needle, a sensor for sensing the position of the reciprocating needle within a cycle of the reciprocating needle and a sequin feeder operably connected to the moveable sewing head. The sequin feeder, the support frame, the sewing head and the sensor are configured at least to sense a position of the sewing head including a reciprocating needle relative to the support frame. The apparatus is further configured to at least in response to user input, present a sequin from the sequin feeder to a needle drop location of the reciprocating needle at a time corresponding to a predetermined part of a reciprocating needle cycle. The apparatus is further configured to in response to the sensed position and movement of the reciprocating needle, adjust a stitch speed of the reciprocating needle based on a size of the sequin.

A third exemplary embodiment of the invention provides a non-transitory computer-readable medium comprising computer program instructions which when executed on a processor of an apparatus causes the apparatus to at least sense, by a sensor, a position of a sewing head having a reciprocating needle relative to a support frame. The computer-readable medium comprising computer program instructions and the processor further cause the apparatus to at least present, by a sequin feeder, a sequin to a needle drop location of the reciprocating needle at a time corresponding to a predetermined part of the reciprocating needle cycle. The apparatus is further caused to in response to the sensed position and movement of the reciprocating needle, adjust a speed of the reciprocating needle based on a size of the sequin.

The following will describe embodiments of the present invention, but it should be appreciated that the present invention is not limited to the described embodiments and various modifications of the invention are possible without departing from the basic principle. The scope of the present invention is therefore to be determined solely by the appended claims.

BRIEF DESCRIPTION OF THE SEVERAL VIEWS OF THE DRAWING(S)

DETAILED DESCRIPTION OF THE INVENTION

In free motion quilting, the location as well as the movement of the needle is determined by a user. That is, the user moves the sewing head of the quilting machine in whichever direction they please to create the quilt. Hence, each stitch in free motion quilting is not preprogrammed by a computer, but made up by the user. As the velocity of the sewing head relative to the workpiece increases or decreases, the speed of the needle needs to also increase or decrease in order to maintain uniform stitch length throughout the workpiece or fabric. A majority of quilting machine manufacturers have solved this dilemma with the use of a X and Y-axis encoder system to observe the velocity of the sewing head or quilter and in turn control the stitching motor speed as needed.

However, it is still difficult to lay down sequins on command in free motion quilting because the machine needs to calculate the velocity and distance moved in the X and Y-axis in addition to having a stitch size compatible with the size of sequins being affixed to the quilt. Exemplary embodiments in accordance with the present disclosure include a method, apparatus and computer-readable medium that enable a free motion quilting machine to lay down sequins on command. Exemplary embodiments allow for the push of a button to simultaneously adjust the speed of the stitching motor from the stitches per inch desired to the stitches per inch that can accommodate the size and required number of sequins at the discretion of the user. Then after applying sequins has stopped the machine can revert back to the preset number of stitches per inch. It is further contemplated, the speed of the stitching motor can be regulated corresponding to the stitches per inch that can accommodate the size of the sequins and the translational speed imparted by the user between the sewing head and the workpiece or quilt.

Figure 1:
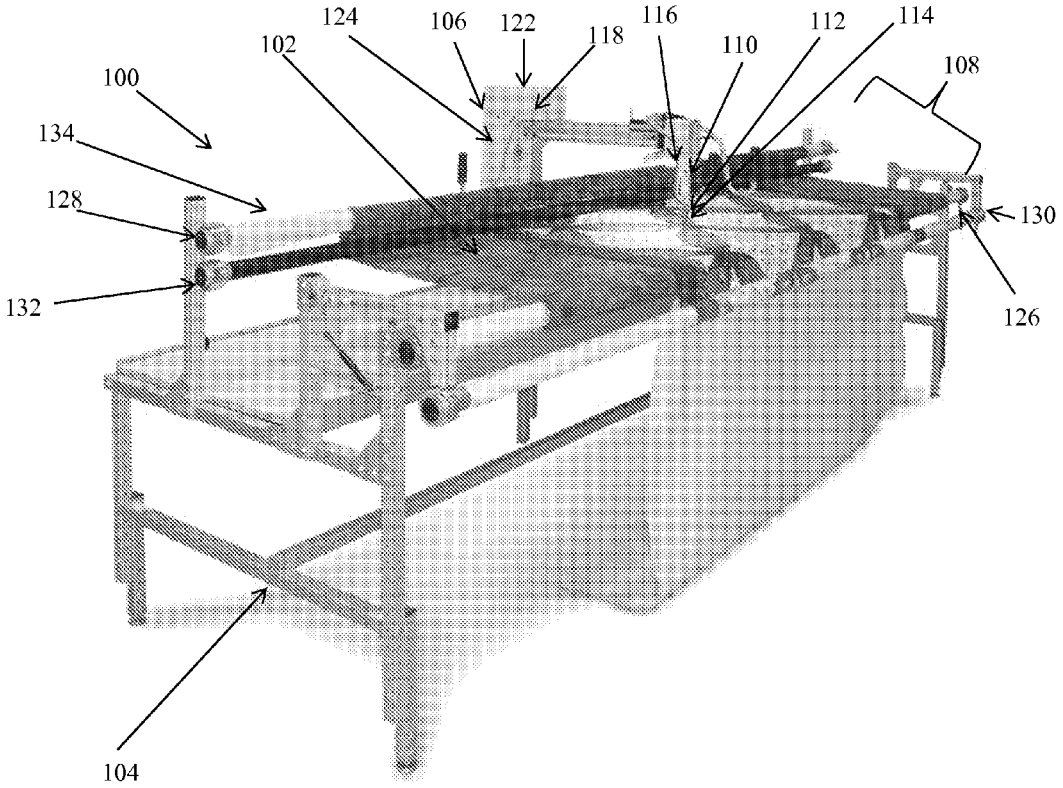
FIG. 1 is a perspective view of a configuration of a quilting machine suitable for use in practicing exemplary embodiments of this invention.

Referring to FIG. 1, a quilting machine 100 for quilting is shown. It should be noted that embodiments of the present invention are not limited to the particular configurations of quilting machine 100.

The term quilting machine 100 encompasses any device for stitching or embroidery of a textile 102. The term includes quilting machines 100 for stitching together multiple layers, such as a filler layer between a top and a bottom textile layer, as well as an embroidery machine.

Quilting machine 100 includes a main frame 104, a sewing machine 106, support frame 108 for supporting or retaining a textile, sewing head 110, a reciprocating needle 112, a sensor 114, a sequin feeder 116, a motor 118, and a sequin button 120 (not shown in FIG. 1). The quilting machine 100 further includes a controller 122 operably connected to the sewing head 110 and an encoder 124. The controller 122 can include a computer processor 126 (not shown) and memory 128 (not shown) for storing computer program instructions. The computer program instructions when executed on the computer processor 126 allow for quilting machine 100 to perform the operations described below.

The controller 122 can also include a display and input, such as a touch screen, keyboard, key pad, and/or mouse. The controller 122 can by physically connected to the main frame 104 or the sewing machine 106. Alternatively, the controller 122 can be a stand-alone device, which communicates with the sewing machine 106 and the X-Y encoder 124 through a wired or wireless connection.

The term textile 102 encompasses any article of manufacture or fabric made by weaving, felting, knitting, crocheting, compressing natural or synthetic fibers. In one configuration, the textile 102 is a quilt. In construction of a quilt it is common to refer to or identify a quilt block. A quilt block is a small part of a quilt top. A number of quilt blocks together make a quilt. The blocks can be the same, or different from each other. Quilt blocks can be pieced or appliqued or represent a given portion of the quilt.

The support frame 104 can be any variety of configurations, wherein the frame includes struts or supports for engaging components described herein. The frame can be made of any of a variety of materials or combinations such as metals, plastics, composites or wood.

Sensor 114 can include optical sensors or motion sensors or any type of sensor capable of monitoring the location of the reciprocating needle 112. Motion sensors allow the controller 122 to "know" the position of the reciprocating needle 112 and whether it is the up or down position. The sensor 112 can be an optical sensor detecting a corresponding portion of the needle or light intensity corresponding to a position of the needle, or a magnetic sensor.

Although the present description is set forth in terms of a sewing machine 106 that is moved during stitching relative to a portion of the textile 102 (or workpiece), it is understood that the textile 102 can be moved relative to a fixed sewing machine. Alternatively, both the sewing machine 106 and the textile 102 can be simultaneously moved.

The sewing machine 106 includes the sewing head 110, typically having a portion above the plane of the workpiece retention area and a second portion below the plane of the workpiece retention area, thereby providing for passage of a portion of the reciprocating needle 112 through the textile 102 and selectively engaging the passage of a length of thread through the textile 102.

Support frame 104 provides the textile retention area that retains the textile 102 or a portion of the textile relative to the main frame 108 and relative to the sewing machine 106. The support frame 104 includes the supply roll assembly 126 and the take roll assembly 128.

The supply roll assembly 126 retains an initial length of textile wound about a supply roller 130. For systems employing a plurality of layers, such quilting having a liner, a filling and a top layer, there may be three supply rollers in the supply roll assembly 126. One of the supply rollers 130 is set such that a portion of the periphery defines a line in a plane of operation of the sewing machine 106.

The take up roller assembly 128 includes a bed roller 132 having a portion of the periphery generally coplanar with a portion of the periphery of the supply roller and a take up roller 134 for winding the stitched textile 102.

The support frame 104 functions to retain a portion of the textile 102 (workpiece) between the line of contact with one of the supply rollers 130 and the bed roller 132 or take up roller 134, if the take up roller compensates for changing diameter of the winding. The supply roll assembly 126 and the take up roll assembly 128 create a tension within the textile 102 between the two assemblies, thereby disposing the intermediate textile in a substantially planar orientation and defining the workpiece retention area.

The X-Y encoder 124 encompasses optical and mechanical sensors for sensing movement of the sewing machine 106 relative to the frame. The X-Y encoder 124 is operable to track and communicate to other elements of quilting machine 100 the direction and velocity of the sewing head 110. The X-Y encoder 124 is operably connected to the controller 122 to communicate to controller 122 the data necessary to determine the direction and speed of the sewing head 110 relative to the workpiece.

In one exemplary embodiment as the sewing machine 106 is moved relative to textile 102, the X-Y encoder 124 senses the direction and speed of the movement of the sewing machine 106. This movement, the X-Y encoder communicates to controller 122 and motor 118. Motor 118 controls the up and down speed of reciprocating needle 112. That is, the cycle frequency of the reciprocating needle 112 is driven by the motor 118. In order to provide uniform stitch length, as the velocity and distance moved of sewing machine 106 relative to the workpiece is increased so is the speed of motor 118 and the up and down speed of reciprocating needle 112. Likewise, as the velocity and distance moved of sewing machine 106 is decreased so is the speed of motor 118 and the up and down speed of the reciprocating needle 112.

Sequin button 120 can be a push button or a switch. Embodiments of the present system allow for sequin button 120 to be any type of unit that has an on and off location. When sequin button 120 is pressed the sequin feeder 116 is configured to place a sequin below the reciprocating needle 112 when the reciprocating needle 112 is in the up position. It is understood the controller can cause the sequin feeder 116 to present the sequin at any of a variety of positions of the needle along its cycle. That is, so long as the needle is not engaged with the workpiece, the sequin feeder 116 can present the sequin when the needle is any of a variety of positions in the cycle, depending on machine or workpiece specific parameters.

The sensor 114 provides sequin feeder 116 with the correct timing for placement. This is repeated as long as sequin button 120 is in the on position. The user can then place sequins on textile 102 at their leisure. The speed of the reciprocating needle 112 and the presentation of a sequin by the sequin feeder 116 is responsive to the movement of sewing machine 106 sensed by sensor 114 and controlled by motor 118. These elements of quilting machine 100 work in tandem to each other to produce sequins attached to textile 102 in a manner that has uniform stitch length and uniform spacing between sequins whether they be affixed next to one another or overlapping.

Additionally, once the sequin button 120 is pressed, the speed of the reciprocating needle 112 can be automatically adjusted to accommodate for the size of the sequin. For instance, this automatic adjustment can occur when the preset stitch length prior to the sequin button 120 being pressed is too short to accommodate the size of the sequin being presented by the sequin feeder 116. In this case the motor 118 would automatically adjust the speed of the reciprocating needle 112 to create a longer stitch length to fit the size of the sequin.

Figure 2:
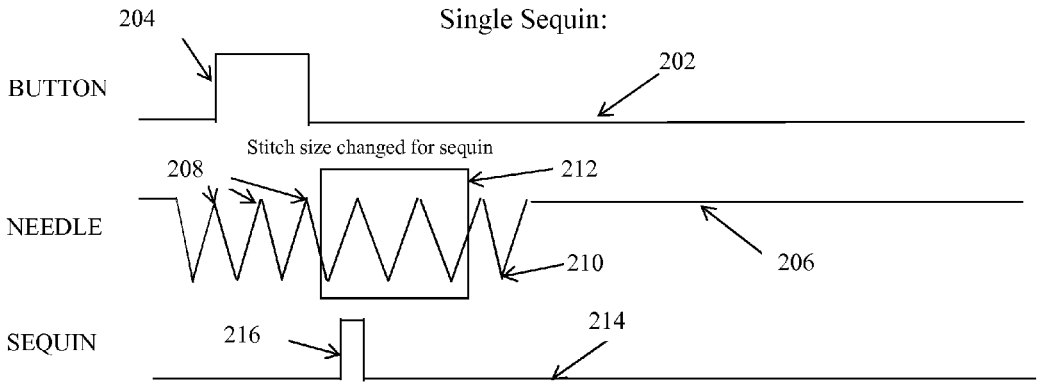
FIG. 2 is a timing diagram for single sequin attachment in accordance with performing exemplary embodiments of this invention.

FIG. 2 represents a timing diagram for single sequin attachment with quilting machine 100 in accordance with performing exemplary embodiments of this disclosure. Line 202 represents the position of sequin button 112. The raised portion of line 202 at section 204 represents the time period for which sequin button 112 is pressed. Line 206 represents the position of reciprocating needle 104. Sections 208 indicate when the reciprocating needle 104 is in the up position and section 210 indicates when the reciprocating needle 104 is in the down position. Block 212 indicates the time period for which the length of the stitch changes due to the size of the sequin being attached. Line 214 represents when a sequin is presented for attachment. The raised portion of line 214 at section 216 indicates when a sequin is presented.

Accordingly, an exemplary process for attaching a single sequin as shown in FIG. 2 starts when sequin button 120 is released after section 204. A sequin is then presented at section 216 when the reciprocating needle 112 is in the up position as show at sections 208. Alternatively, a sequin can be presented while the reciprocating needle 112 is moving into the up position or moving into the down position. Exemplary embodiments provide that a sequin can be presented at any point in the reciprocating needle 112 cycle after the reciprocating needle 112 has cleared the work piece or fabric. FIG. 2 also shows that the reciprocating needle 112 also adjusts its stitch length to accommodate for the size of the sequin in block 212.

Figure 3:
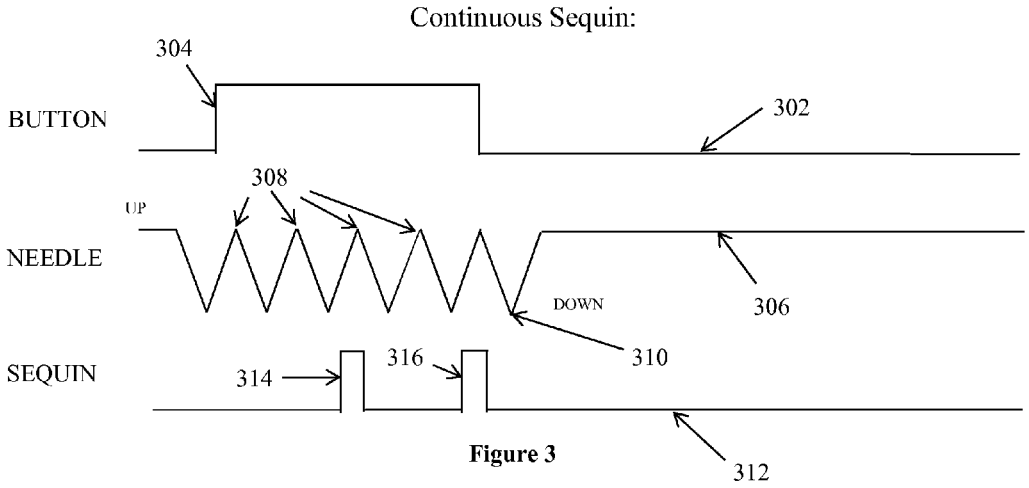
FIG. 3 is a timing diagram for continuous sequin attachment in accordance with performing exemplary embodiments of this invention.

FIG. 3 represents a timing diagram for continuous sequin attachment with quilting machine 100 in accordance with performing exemplary embodiments of this invention. Line 302 represents the position of a sequin button 120. The raised portion of line 302 at section 304 represents the time period for which sequin button 120 is pressed. Line 306 represents the position of reciprocating needle 112. Sections 308 indicate when the reciprocating needle 104 is in the up position and sections 310 indicates when the reciprocating needle 112 is in the down position. Line 312 represents when a sequin is presented for attachment. The raised portion of line 312 at sections 314 and 316 indicate when a sequin is presented for attachment.

An exemplary process for continuously attaching sequins as in FIG. 3 begins when sequin button 120 is pressed at section 304. A sequin is presented at sections 314 and 316 when the reciprocating needle 112 is in the up position at sections 308. In this embodiment, a sequin is not presented every time the reciprocating needle 112 is in the up position. Rather a sequin is presented at sections 314 and 316 with an interceding stitch shown by section 308 between them. This has the visual effect of presenting stitched sequins that are side by side. Again in an alternative embodiment, a sequin can be presented while the reciprocating needle 112 is moving into the up position or moving into the down position. Exemplary embodiments provide that a sequin can be presented at any point in the reciprocating needle 112 cycle after the reciprocating needle 112 has cleared the work piece or fabric. Then after the sequin button 120 is released sequins are no longer presented.

Figure 4:
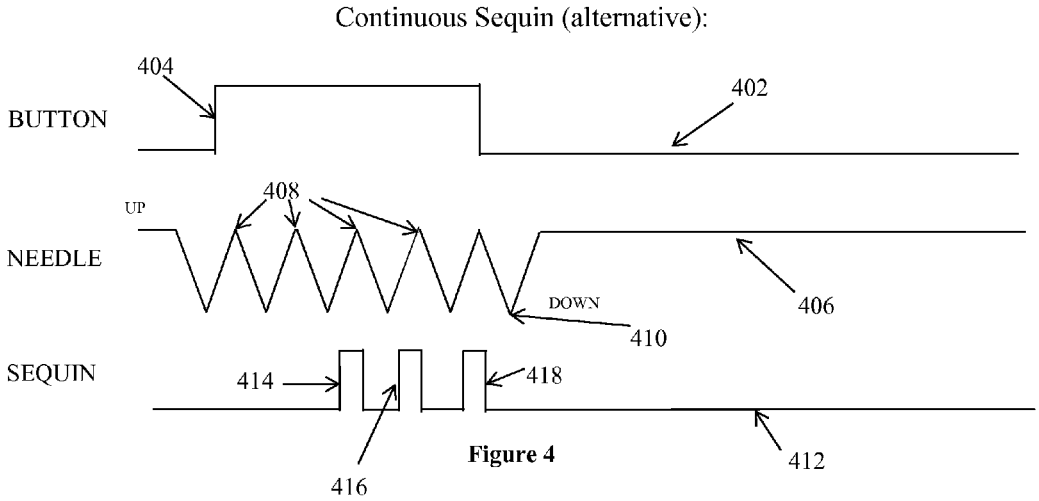
FIG. 4 is an alternative timing diagram for continuous sequin attachment in accordance with performing exemplary embodiments of this invention.

FIG. 4 represents a timing diagram for an alternative process of continuous sequin attachment with quilting machine 100 in accordance with performing exemplary embodiments of this disclosure. Line 402 represents the position of a sequin button 120. The raised portion of line 402 at section 404 represents the time period for which sequin button 120 is pressed. Line 406 represents the position of reciprocating needle 112. Sections 408 indicate when the reciprocating needle 112 is in the up position and sections 410 indicate when the reciprocating needle 112 is in the down position. Line 412 represents when a sequin is presented for attachment. The raised portion of line 412 at sections 414, 416, and 418 indicate when a sequin is presented for attachment.

Another exemplary process for continuously attaching sequins as in FIG. 4 begins when sequin button 120 is pressed at section 404. A sequin is presented at sections 414, 416, and 418 when the reciprocating needle 112 is in the up position at sections 408. In this embodiment a sequin is presented at sections 414, 416, and 418 without an interceding section 408. This has the visual effect of presenting stitched sequins that are overlapping. Alternatively, a sequin can presented while the reciprocating needle 112 is moving into the up position or moving into the down position. Exemplary embodiments provide that a sequin can be presented at any point in the reciprocating needle 112 cycle after the reciprocating needle 112 has cleared the work piece or fabric. Then after the sequin button 120 is released, sequins are no longer presented.

Figure 5:
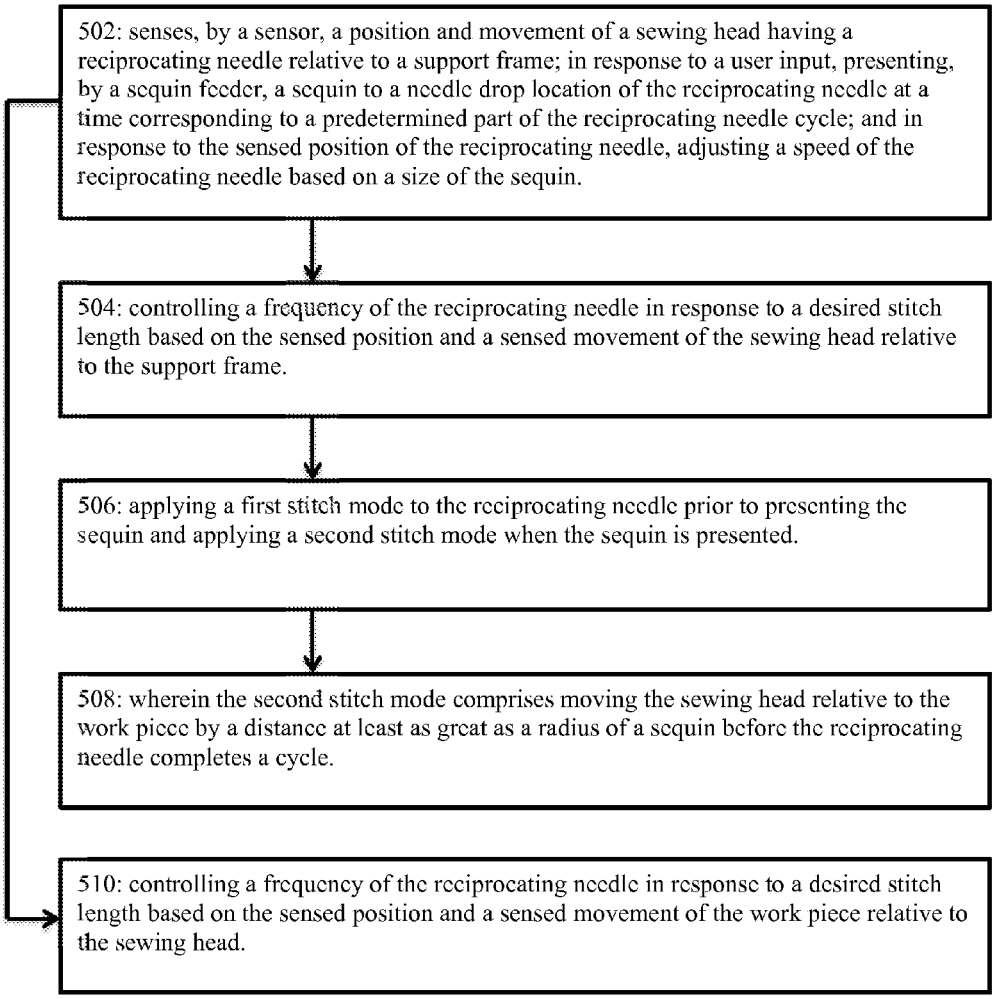
FIG. 5 is a logic flow diagram in accordance with a method, apparatus and computer readable-medium for performing exemplary embodiments of this invention.

FIG. 5 presents a summary of the above teachings for affixing a sequin to a work piece. Block 502 presents senses, by a sensor, a position and movement of a sewing head having a reciprocating needle relative to a support frame; in response to a user input, presenting, by a sequin feeder, a sequin to a needle drop location of the reciprocating needle at a time corresponding to a predetermined part of the reciprocating needle cycle; and in response to the sensed position of the reciprocating needle, adjusting a speed of the reciprocating needle based on a size of the sequin. Then block 504 specifies further controlling a frequency of the reciprocating needle in response to a desired stitch length based on the sensed position and a sensed movement of the sewing head relative to the support frame.

Some of the non-limiting implementations detailed above are also summarized at FIG. 5 following block 504. Block 506 relates to further applying a first stitch mode to the reciprocating needle prior to presenting the sequin and applying a second stitch mode when the sequin is presented. Block 508 specifies wherein the second stitch mode comprises moving the sewing head relative to the work piece by a distance at least as great as a radius of a sequin before the reciprocating needle completes a cycle. Block 510 further specifies controlling a frequency of the reciprocating needle in response to a desired stitch length based on the sensed position and a sensed movement of the work piece relative to the sewing head.

Thus, the present system varies the cycle frequency of the reciprocating needle corresponding to the user imparted velocity and distance moved of the sewing machine relative to the workpiece, the user initiated sequin location, the size of the sequin (radius of sequin), wherein the stitch length is automatically switched between an initial user selected stitch length and a stitch length necessary to affix the sequins to the workpiece in response to user input.

The logic diagram of FIG. 5 may be considered to illustrate the operation of a method, and a result of execution of computer program instructions stored in a computer-readable memory, and a specific manner in which components of an electronic device are configured to cause that electronic device to operate, whether such an electronic device is a quilting machine or some other device, or one or more components thereof. The various blocks shown in FIG. 5 may also be considered as a plurality of coupled logic circuit elements constructed to carry out the associated functions(s), or specific result of strings of computer program instructions or code stored in a memory.

Various embodiments of the computer readable medium include any data storage technology type which is suitable to the local technical environment, including but not limited to semiconductor based memory devices, magnetic memory devices and systems, optical memory devices and systems, fixed memory, removable memory, disc memory, flash memory, dynamic random-access memory (DRAM), static random-access memory (SRAM), electronically erasable programmable read-only memory (EEPROM) and the like. Various embodiments of the processor include but are not limited to general purpose computers, special purpose computers, microprocessors, digital signal processors and multicore processors.

What is claimed is:

1. A method for affixing a sequin to a work piece, the method comprising:
   - sensing, by a sensor, a position and movement of a sewing head having a reciprocating needle relative to a support frame;
   - in response to a user input, presenting, by a sequin feeder, a sequin to a needle drop location of the reciprocating needle at a time corresponding to a predetermined part of the reciprocating needle cycle; and
   - in response to the sensed position of the reciprocating needle, adjusting a speed of the reciprocating needle based on a size of the sequin.

2. The method according to claim 1, further comprising controlling a frequency of the reciprocating needle in response to a desired stitch length based on the sensed position and a sensed movement of the sewing head relative to the support frame.

3. The method according to claim 2, further comprising applying a first stitch mode to the reciprocating needle prior to presenting the sequin and applying a second stitch mode when the sequin is presented.

4. The method according to claim 3, wherein the second stitch mode comprises moving the sewing head relative to the work piece by a distance at least as great as a radius of a sequin before the reciprocating needle completes a cycle.

5. The method according to claim 1, wherein the sensor includes a X direction sensor and a Y direction sensor.

6. The method according to claim 1, further comprising controlling a frequency of the reciprocating needle in response to a desired stitch length based on the sensed position and a sensed movement of the work piece relative to the sewing head.

7. An apparatus for affixing a sequin to a work piece, the apparatus comprising:
   - a support frame;
   - a sewing head including a reciprocating needle;
   - a sensor for sensing the position of the reciprocating needle within a cycle of the reciprocating needle;
   - a sequin feeder operably connected to the moveable sewing head, wherein the sequin feeder, the support frame, the sewing head and the sensor are configured at least to:
     - sense a position of the sewing head including a reciprocating needle relative to the support frame;
     - in response to user input, present a sequin from the sequin feeder to a needle drop location of the reciprocating needle at a time corresponding to a predetermined part of a reciprocating needle cycle; and
     - in response to the sensed position and movement of the reciprocating needle, adjust a stitch speed of the reciprocating needle based on a size of the sequin.

8. The apparatus according to claim 7, wherein the apparatus is further configured to control a frequency of the reciprocating needle in response to a desired stitch length based on the sensed position and a sensed movement of the sewing head relative to the support frame.

9. The apparatus according to claim 8, wherein the apparatus is further configured to apply a first stitch mode to the reciprocating needle prior to presenting the sequin and to apply a second stitch mode when the sequin is presented.

10. The apparatus according to claim 9, wherein the second stitch mode comprises moving the sewing head relative to the work piece by a distance at least as great as a radius of a sequin before the reciprocating needle completes a cycle.

11. The apparatus according to claim 7, wherein the sewing head is moveable relative to the support frame.

12. The apparatus according to claim 7, wherein the sewing head is moveable relative to the support frame in response to user contact.

13. The apparatus according to claim 7, wherein the apparatus is further configured to control a frequency of the reciprocating needle in response to a desired stitch length based on the sensed position and a sensed movement of the work piece relative to the sewing head.

14. A non-transitory computer-readable medium comprising computer program instructions which when executed on a processor of an apparatus causes the apparatus to at least:

sense, by a sensor, a position of a sewing head having a reciprocating needle relative to a support frame;

present, by a sequin feeder, a sequin to a needle drop location of the reciprocating needle at a time corresponding to a predetermined part of the reciprocating needle cycle; and in response to the sensed position and movement of the reciprocating needle, adjust a speed of the reciprocating needle based on a size of the sequin.

15. The non-transitory computer-readable medium according to claim 14, wherein the computer program instructions with the processor further cause the apparatus to control a frequency of the reciprocating needle in response to a desired stitch length based on the sensed position and a sensed movement of the sewing head relative to the support frame.

16. The non-transitory computer-readable medium according to claim 15, wherein the computer program instructions with the processor further cause the apparatus to apply a first stitch mode to the reciprocating needle prior to presenting the sequin and to apply a second stitch mode when the sequin is presented.

17. The non-transitory computer-readable medium according to claim 16, wherein the second stitch mode comprises moving the sewing head relative to a work piece by a distance at least as great as a radius of a sequin before the reciprocating needle completes a cycle.

18. The non-transitory computer-readable medium according to claim 14, wherein the computer program instructions with the processor further cause the apparatus to control a frequency of the reciprocating needle in response to a desired stitch length based on the sensed position and a sensed movement of a work piece relative to the sewing head.

* * * * *